US007495195B2

(12) United States Patent
Tung et al.

(10) Patent No.: US 7,495,195 B2
(45) Date of Patent: Feb. 24, 2009

(54) ELECTRIC HEATING DEVICE

(75) Inventors: Chao-Nien Tung, Guangdong (CN); Chuen-Shu Hou, Guangdong (CN); Chih-Hao Yang, Guangdong (CN)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 173 days.

(21) Appl. No.: 11/308,699

(22) Filed: Apr. 24, 2006

(65) Prior Publication Data

US 2006/0289475 A1 Dec. 28, 2006

(30) Foreign Application Priority Data

Jun. 16, 2005 (CN) ..... 2005 1 0035366

(51) Int. Cl.
*H05B 3/10* (2006.01)
*H05B 3/02* (2006.01)

(52) U.S. Cl. ..... 219/548; 219/546

(58) Field of Classification Search ..... 219/548, 219/549, 550, 551, 538, 468, 338, 539, 540, 219/541, 542, 543, 544, 545, 546, 547; 338/22, 338/23, 24, 25

See application file for complete search history.

(56) References Cited

U.S. PATENT DOCUMENTS 5,995,711 A * 11/1999 Fukuoka et al. ..... 392/347
6,720,536 B2 4/2004 Bohlender
7,282,678 B2 * 10/2007 Tung et al. ..... 219/520

FOREIGN PATENT DOCUMENTS

CN 2331142 Y 7/1999
JP 5-29069 2/1993

* cited by examiner

*Primary Examiner*—Daniel L Robinson
(74) *Attorney, Agent, or Firm*—Winston Hsu

(57) ABSTRACT

An electric heating device includes an electric heater (10) and at least one heat radiator (30, 40) thermally attached to the electric heater. The electric heater includes a pair of electrode plates (12, 14) parallel to each other and a plurality of PTC (Positive Temperature Coefficient) heating elements (16) sandwiched between and electrically connecting the electrode plates. The heating elements are alternately arranged with a plurality of insulation sheets (18). An electrically-insulating and heat-conductive insulation frame (19) encloses the electrode plates therein for electrically insulating the electric heater from the heat radiator.

19 Claims, 5 Drawing Sheets

ELECTRIC HEATING DEVICE

FIELD OF THE INVENTION

The present invention relates generally to electric heating device, and more particularly to an electric heating device having PTC (Positive Temperature Coefficient) heating elements.

DESCRIPTION OF RELATED ART

Electric heating devices are in common use for warming body parts, air conditioning, motor vehicles, industrial plants and the like. A conventional electric heating device comprises a base having at least one electric heating element supported on or adjacent thereto. The heating elements are generally of coiled wire or ribbon form, having electrical terminals at opposite ends thereof for connection to a power supply. A rod-like heat sensor is generally provided extending at least partly across the heating device and overlying the heating elements to sense the temperature of the electric heating device.

The electric heating elements are generally made of a metal which can endure high temperatures, such as nickel, chromium or the like. The electrical resistance of the heating elements is thus kept constant with varying temperature. During operation of the heating device, an electrical current flows through the heating elements, whereby the heating elements generate heat. Due to the constant electrical resistance of the heating elements, initially the heating elements need a relatively longer time to warm up to a predetermined temperature. However, after reaching the predetermined temperature the current continues to supply to the heat the heating elements whereby the heating device may be overheated. Thus such a heating device is both unsafe and has a low energy conversion efficiency.

Therefore, there is a need for an electric heating device which has a better energy conversion efficiency and has no danger of overheating.

SUMMARY OF INVENTION

According to a preferred embodiment of the present invention, an electric heating device includes an electric heater and at least one heat radiator thermally attached to the electric heater. The electric heater includes a pair of electrode plates parallel to each other and a plurality of PTC heating elements and insulation sheets sandwiched between the electrode plates. The PTC heating elements electrically connect with the electrode plates. The heating elements and insulation sheets are arranged in alternating order. An electrically-insulating and heat-conductive insulation frame encloses the electrode plates therein so as to electrically insulate the electric heater from the heat radiator. Due to the non-linear positive temperature coefficient of the PTC heating elements of the heating device, the electric heating device can rapidly heat to and stay at a desired stable temperature. Thus this device enhances the energy conversion efficiency, and improves the reliability and useful life of the heating device.

Other advantages and novel features of the present invention will be drawn from the following detailed description of a preferred embodiment of the present invention with attached drawings, in which:

DETAILED DESCRIPTION

Figure 1:
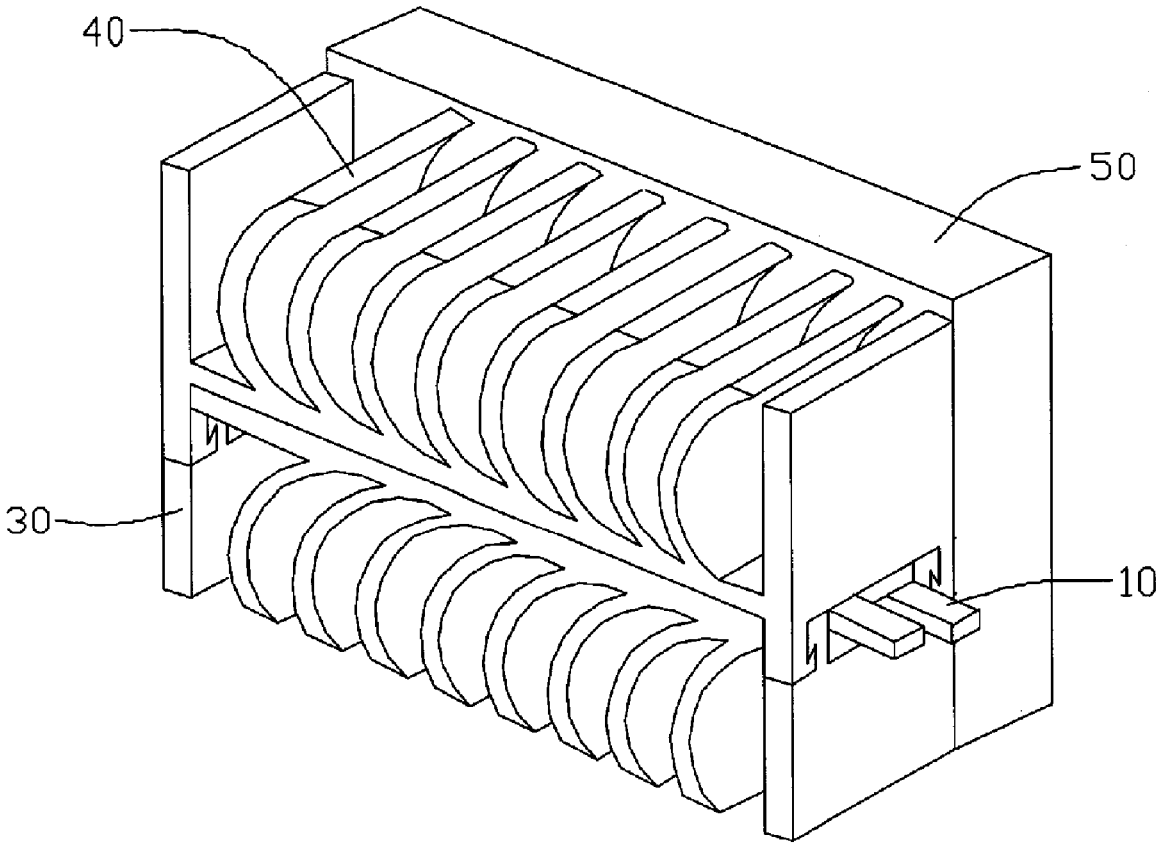
FIG. 1 is an isometric, assembled view of an electric heating device in accordance with a preferred embodiment of the present invention.
Figure 2:
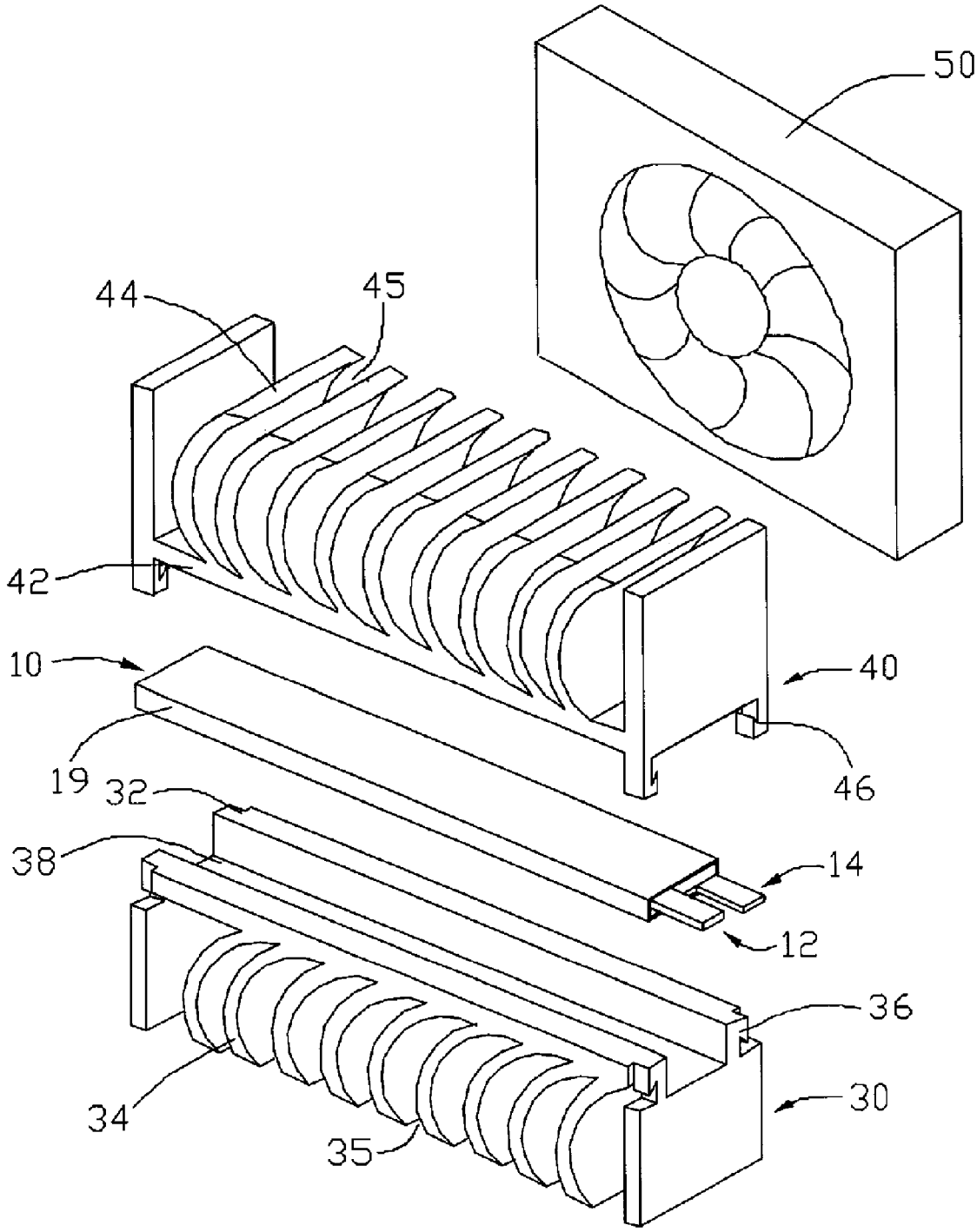
FIG. 2 is an isometric, exploded view of the electric heating device of FIG. 1.

Referring to FIGS. 1-2, an electric heating device according to a preferred embodiment of the present invention includes an electric heater 10, a first and second heat radiators 30, 40 thermally attached to the electric heater 10, and a fan 50 arranged at a common side of the electric heater 10 and the first and second heat radiators 30, 40 for generating an airflow through the heat radiators 30, 40.

Figure 3:
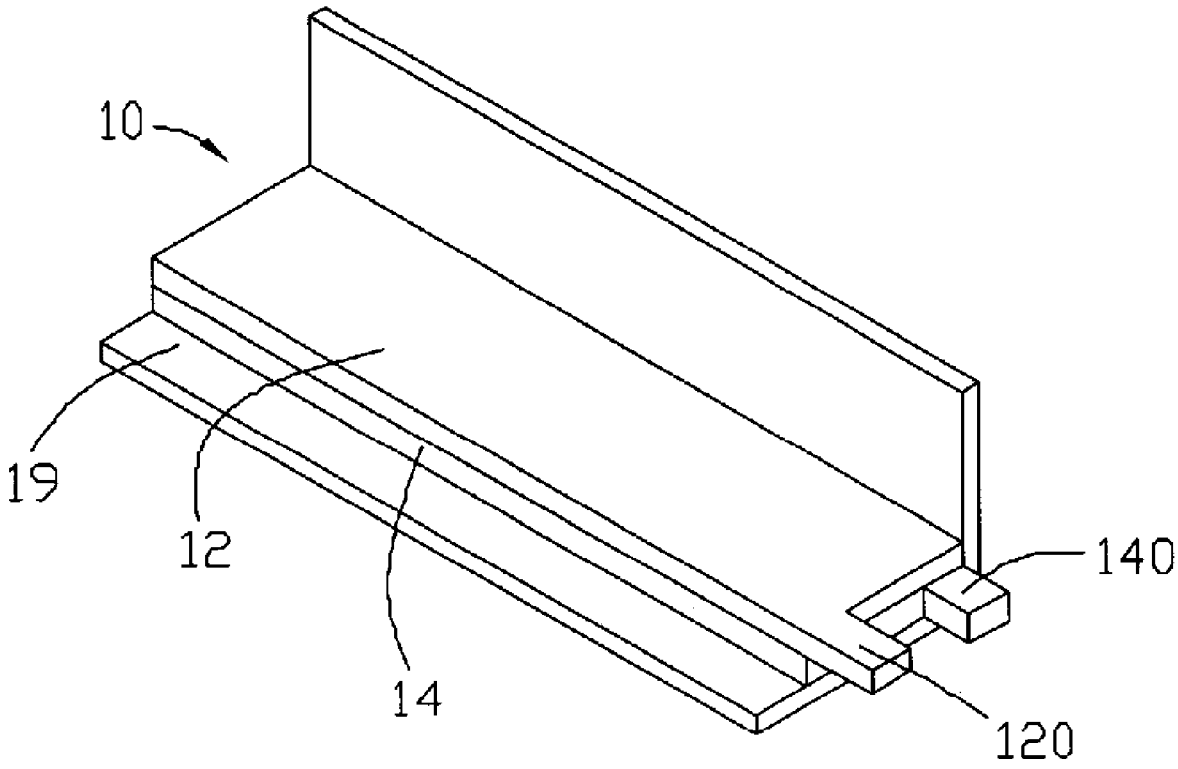
FIG. 3 is an isometric view of an electric heater with an unfurled insulation frame of the electric heating device.
Figure 4:
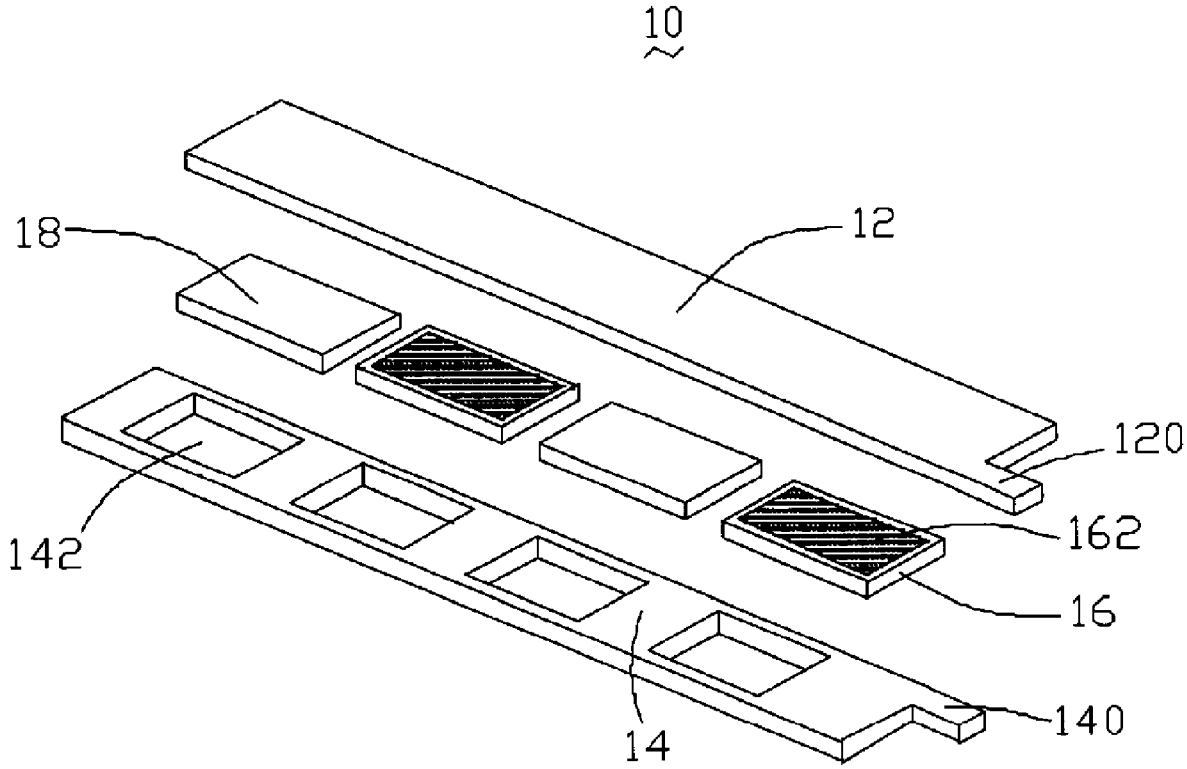
FIG. 4 an isometric, exploded view of the electric heater.

Referring to FIGS. 3-4, the electric heater 10 includes an upper and lower electrode plates 12, 14 arranged parallel to each other, and a plurality of PCT (Positive Temperature Coefficient) heating elements 16 and insulation sheets 18 sandwiched between the electrode plates 12, 14. Each of the electrode plates 12, 14 is rectangular shaped and thin, and includes an inner surface electrically contacting the heating elements 16 and an outer surface opposite to a corresponding inner surface. A plurality of slots 142 is defined in the inner surface of the lower electrode plate 14 for receiving the heating elements 16 and insulation sheets 18 therein. Each slot 142 has a depth approximately the same as or less than the height of the heating elements 16. Electric terminals 120, 140 are formed on ends of the electrode plates 12, 14, respectively, to electrically connect a power source (not shown), respectively.

The heating elements 16 and insulation sheets 18 are alternately received in the slots 142 of the lower electrode plate 14. Therefore an insulation sheet 18 is arranged between each two neighboring heating elements 16 to insulate the heating elements 16. The heating elements 16 electrically connect the upper and lower electrode plates 12, 14 in parallel. The insulation sheets 18 are made of electrical insulation material, such as ceramic substrate, polymer material.

The PTC heating elements 16 are made of semi-conductive ceramic based on $BaTiO_3$ composition and have an electric layer 162 coated on two opposite sides thereof for electrically contacting the electrode plates 12, 14, respectively. The electric layers 162 are made of a material having an excellent electrical conductivity, such as metal, metal oxide, superconducting materials, etc. The metal oxide can be selected from ITO-based (indium-tin oxide based) materials or IZO-based (indium-zinc oxide based) materials. The superconducting materials can be selected from one of the following materials: $Yba_2Cu_3O7$, $LaSr_2Cu_3O_7$ and their composites. The heating elements 16 are formed in a flat rectangular shape. Alternatively, the heating elements 16 can be manufactured in other forms, such as circular or donut-shaped. Because of the non-linear positive temperature coefficient of the heating elements 16, electrical resistance of the PTC heating elements 16 varies with its temperature. When the temperature of the heating elements 16 is below the Curie point, the electrical resistance value slightly decreases as temperature rises. But when the temperature exceeds the Curie point, the resistance increases abruptly. When the temperature exceeds the maximum resistance temperature, the temperature coefficient becomes negative again. The Curie point is the temperature at which the resistance of the heating elements 16 begins to rise sharply and the resistance value is approximately twice the minimum resistance. The Curie point can be adjusted as required by changing the composition of the heating elements 16.

An insulation frame 19 covers the electrode plates 12, 14 so as to insulate the electric heater 10 from the heat radiators 30, 40. The insulation frame 19 is made of electrical insulation material with excellent thermal conductivity and heat resistance, such as a ceramic substrate or polymer material. Thus the heat generated by the electric heater 10 can be conducted to the heat radiators 30, 40 quickly and reliably.

Each of the first and second heat radiators 30, 40 includes a base 32, 42 and a plurality of fins 34, 44 respectively extending therefrom. The fins 34, 44 are parallel to each other and each of the fins 34, 44 is arc shaped. An arc shaped flow channel 35, 45 is formed between each two neighboring fins 34, 44 for channeling the airflow generated by the fan 50. In this embodiment the fins 34, 44 are integrally formed with the base 32, 42. Alternatively, the fins 34, 44 and the base 32, 42 can be formed separately and then joined together by soldering. A groove 38 is defined in the base 32 of the first heat radiator 30 for receiving the electric heater 10 therein. The groove 38 has a depth approximately the same as the height of the electric heater 10. Thus the electric heater 10 remains thermally attached to the first and second heat radiators 30, 40. A hook 36, 46 extends from each of four corners of each of the first and second heat radiators 30, 40 to the other one of the first and second heat radiators 30, 40. Therefore the first and second heat radiators 30, 40 can engage with each other by each of the hooks 36, 46 locking with a corresponding hook 46, 36 of the other heat radiators 40, 30.

When assembled, the heating elements 16 and insulation sheets 18 are alternately received in the slots 142 of the lower electrode plate 14. The inner surface of the lower electrode plate 14 electrically contacts the heating elements 16. The upper electrode plate 12 covers on the lower electrode plate 14 with an inner surface electrically contacting the heating elements 16. The insulation frame 19 covers the electrode plate 12, 14 and encloses the PTC heating elements 16 therein. Then the groove 38 of the first heat radiator 30 receives the electric heater 10 with the insulation frame 19 wrapped thereon. A bottom wall of the insulation frame 19 thermally attaches to the base 32 of the first heat radiator 30. The second heat radiator 40 abuts a top wall opposite to the bottom wall of the insulation frame 19. Each hook 36, 46 of the first and second heat radiators 30, 40 engages with a corresponding hook 46, 36 of the other heat sink 40, 30. Therefore the heat radiators 30, 40 lock with each other and sandwich the electric heater 10 therebetween. The bases 32, 42 of the first and second heat radiators 30, 40 thermally attach to two opposite walls of the insulation frame 19, respectively.

During operation, the fan 50 is arranged on a side of the electric heater 10 communicating with the flow channels 35, 45 of the first and second heat radiators 30, 40. The electric terminals 120, 140 of the electrode plates 12, 14 connect to the power source through wires (not shown). As voltage is applied to the heating elements 16 through the electrical terminals 120, 140 of the electrode plates 12, 14, the current heats the heating elements 16. Initially while voltage increases the resistance drops, the current increases rapidly and quickly heats the heating elements 16 to reach a predetermined temperature. The heat generated by the heating elements 16 is conducted to the fins 34, 44 of the heat radiators 30, 40 attached thereon. The airflow generated by the fan 50 flows into the flow channels 35, 45 to exchange heat with the fins 34, 44. Therefore the heat generated by the heating elements 16 is dissipated to ambient air thereby warming the ambient air. When the heating elements 16 reach the Curie point where the heat generated is the same as the heat dissipated, the electrical resistance of the heating elements 16 increases sharply, whilst the current supplied to the heating elements 16 decrease dramatically. This increase in resistance is sufficient to substantially to compensate the reduce of the current supplied to the heating elements 16. Thus, a small amount of current flowing through the heating elements 16 is sufficient to maintain the temperature of the electric heating device at the required level since the resistance of the heating elements 16 is increased. With the non-linear PTC heating elements 16, the electric heating device can rapidly heat to and remain at a stable temperature, thereby enhancing the energy conversion efficiency, and improving the reliability and useful life of the heating device.

Figure 5:
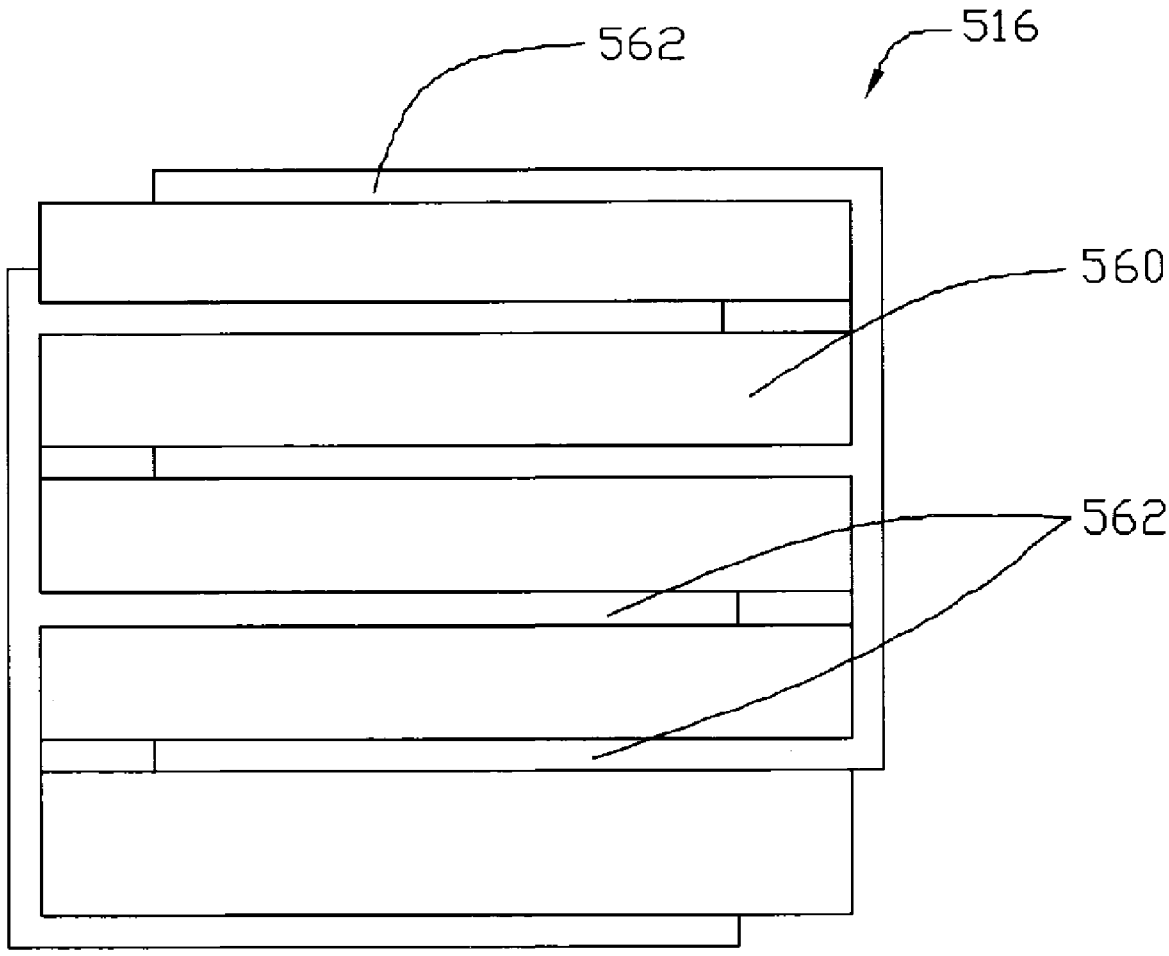
FIG. 5 shows another embodiment of a heating element of the electric heater.

FIG. 5 shows a second embodiment of a heating element 516 according to the present invention. In this embodiment, the heating element 516 includes a plurality of layer-structured PTC heating sheets 560. The heating sheets 560 are stacked together with each heating sheet 560 sandwiched between two electric layers 562 respective of right and left electrode combs (not labeled). The heating element 516 is received in a corresponding one of the slots 142 of the lower electrode plate 14 with a bottom of the left electrode comb electrically connecting with the lower electrode plate 14; then, the upper electrode plate 12 is mounted on the lower electrode plate 14 and electrically connects with a top of the right electrode comb. Therefore, each of the heating sheets 560 of the heating element 516 electrically connects with a positive upper electric layer 562 and a negative lower electrical layer 562 when the upper electrode plate 12 is connected to a positive terminal of the power source and the lower electrode plate 14 is connected to a negative terminal.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. An electric heating device comprising:

an electric heater comprising:

a pair of electrode plates parallel to each other;

a plurality of PTC (Positive Temperature Coefficient) heating elements sandwiched between and electrically connecting the electrode plates, a plurality of insulation sheets being alternately arranged with the heating elements; and an electrically-insulating and heat-conductive insulation frame enclosing the electrode plates therein; and at least one heat radiator thermally attached to the insulation layer of the electric heater;

wherein each of the heating elements comprises an electric layer formed on two opposite sides thereof for electrically connecting the electrode plates, and the electric layers are made of ITO-based (indium-tin oxide based) materials or IZO-based (indium-zinc oxide based) materials.

2. The electric heating device as claimed in claim 1, wherein a plurality of slots is defined in at least one of the electrode plates receiving the heating elements and insulation sheets therein.

3. The electric heating device as claimed in claim 1, wherein each heating element comprises a plurality of heating sheets stacked together, the heating sheets electrically connect the electrode plates.

4. The electric heating device as claimed in claim 1, wherein the at least one heat radiator comprises a base defining a groove receiving the electric heater therein and a plurality of fins extending therefrom.

5. The electric heating device as claimed in claim 4, wherein the fins are arc shaped and parallel to each other, an arc shaped air flow channel is formed between each two neighboring fins.

6. The electric heating device as claimed in claim 4, wherein the at least one heat radiator comprises first and second heat radiators thermally attaching to two opposite walls of the electric heater, a plurality of hooks extend from each heat radiator and engages with corresponding hooks of the other heat radiator of the first and second heat radiators.

7. The electric heating device as claimed in claim 5, further comprising a fan arranged at a side communicating with the air flow channels of the at least one heat radiator for generating an airflow.

8. An electric heating device comprising:

an electric heater comprising:

a pair of electrode plates parallel to each other;

a plurality of PCT (Positive Temperature Coefficient) heating elements sandwiched between and electrically connecting the electrode plates, a plurality of insulation sheets being alternately arranged with the heating elements; and an electrically-insulating and heat-conductive insulation frame enclosing the electrode plates therein; and at least one heat radiator thermally attached to the insulation layer of the electric heater;

wherein each of the heating elements comprises an electric layer formed on two opposite sides thereof for electrically connecting the electrode plates, and the electric layers are made of one of the following materials: $Yba_2Cu_3O_7$, $LaSr_2Cu_3O_7$ and their composites.

9. The electric heating device as claimed in claim 8, wherein a plurality of slots is defined in at least one of the electrode plates receiving the heating elements and insulation sheets therein.

10. The electric heating device as claimed in claim 8, wherein each heating element comprises a plurality of heating sheets stacked together, the heating sheets electrically connect the electrode plates.

11. The electric heating device as claimed in claim 8, wherein the at least one heat radiator comprises a base defining a groove receiving the electric heater therein and a plurality of fins extending therefrom.

12. The electric heating device as claimed in claim 11, wherein the at least one heat radiator comprises first and second heat radiators thermally attaching to two opposite walls of the electric heater, a plurality of hooks extend from each heat radiator and engages with corresponding hooks of the other heat radiator of the first and second heat radiators.

13. The electric heating device as claimed in claim 11, wherein the fins are arc shaped and parallel to each other, an arc shaped air flow channel is formed between each two neighboring fins.

14. The electric heating device as claimed in claim 13, further comprising a fan arranged at a side communicating with the air flow channels of the at least one heat radiator for generating an airflow.

15. An electric heating device comprising:

an electric heater comprising:

a pair of electrode plates parallel to each other;

a plurality of PCT (Positive Temperature Coefficient) heating elements sandwiched between and electrically connecting the electrode plates, a plurality of insulation sheets being alternately arranged with the heating elements; and an electrically-insulating and heat-conductive insulation frame enclosing the electrode plates therein; and at least one heat radiator thermally attached to the insulation layer of the electric heater;

wherein the at least one heat radiator comprises a base defining a groove receiving the electric heater therein and a plurality of fins extending therefrom; and wherein the at least one heat radiator comprises first and second heat radiators thermally attaching to two opposite walls of the electric heater, and a plurality of hooks extend from each heat radiator and engage with corresponding hooks of the other heat radiator of the first and second heat radiators.

16. The electric heating device as claimed in claim 15, wherein a plurality of slots is defined in at least one of the electrode plates receiving the heating elements and insulation sheets therein.

17. The electric heating device as claimed in claim 15, wherein each heating element comprises a plurality of heating sheets stacked together, and the heating sheets electrically connect with the electrode plates.

18. The electric heating device as claimed in claim 15, wherein the fins are arc shaped and parallel to each other, and an arc shaped air flow channel is formed between each two neighboring fins.

19. The electric heating device as claimed in claim 18, further comprising a fan arranged at a side communicating with the air flow channels of the at least one heat radiator for generating an airflow.

* * * * *